United States Patent [19]

Jochum

[11] Patent Number: 4,595,134

[45] Date of Patent: Jun. 17, 1986

[54] EXPLOSIVE CHARGE OPERATED DEVICE FOR DRIVING FASTENING ELEMENTS

[75] Inventor: Peter Jochum, Meiningen, Austria

[73] Assignee: Hilti Aktiengesellschaft, Fevstentum, Luxembourg

[21] Appl. No.: 759,079

[22] Filed: Jul. 25, 1985

[30] Foreign Application Priority Data

Jul. 26, 1984 [DE] Fed. Rep. of Germany ..... 3427616

[51] Int. Cl.[4] ..... B25C 1/10; B25C 1/14

[52] U.S. Cl. ..... 227/9; 227/10

[58] Field of Search ..... 227/8, 9, 10, 11

[56] References Cited

U.S. PATENT DOCUMENTS 3,204,400 9/1965 Kuavle ..... 227/9 X
4,153,192 5/1979 Jochum ..... 227/10
4,382,533 5/1983 Buechel et al. ..... 227/9 X

FOREIGN PATENT DOCUMENTS 2709065 9/1978 Fed. Rep. of Germany ..... 227/9

*Primary Examiner*—Paul A. Bell

*Attorney, Agent, or Firm*—Toren, McGeady, Stanger, Goldberg & Kiel

[57] ABSTRACT

In an explosive charge operated device for driving fastening elements into a receiving material, a throttling device is arranged for conveying explosive gases from a barrel out of the device housing. The throttling device is a tubular member containing a displaceable nozzle needle. The position of the nozzle needle controls the flow of gas out of the tubular member. When an explosive charge is fired, the barrel is axially displaceable opposite to the direction for driving a fastening element from the device. As the barrel is displaced the throttling cross-section through the throttling member is increased as the throttling member is displaced so that the outflow of the explosive gases and the peak values of the sound level is considerably reduced as compared to similar previously known devices.

9 Claims, 2 Drawing Figures

EXPLOSIVE CHARGE OPERATED DEVICE FOR DRIVING FASTENING ELEMENTS

BACKGROUND OF THE INVENTION

The present invention is directed to an explosive charge operated device for driving fastening elements and includes an axially displaceable barrel with a driving piston guided in the barrel. Flow passageways are provided from the barrel for discharging propellant gases out of the barrel into the atmosphere.

Soundproofing is a considerable problem in explosive powder operated devices for driving fastening elements. A very high sound level is generated by the propellant gases flowing out of the device at a high velocity. The high sound level has an annoying effect in the region where the device is used and in particular on the device operator. Devices are known for driving fastening elements using an integrated or attached silencer. Such silencers are based on the expansion principle where the gases generated in the firing of the explosive charge are discharged from the device through one or a number of expansion chambers into the atmosphere. Openings are located between the expansion chambers with a more or less large cross-section. In the region of the openings the propellant gases flow at a relatively high velocity and in the subsequent expansion chambers a reduction in the velocity energy takes place due to the turbulence of the gases.

Up until the present time, the silencers used have resulted in a relatively high loss of the fastening element driving energy. In particular, if the exhaust openings are exposed relatively early in the displacement of the driving piston in the driving direction, a large portion of the propellant gases escape practically unused into the atmosphere. Moreover, if the exhaust openings are opened in a latter phase of the driving operation, a very rapid rise takes place in the sound level attaining a high peak value.

SUMMARY OF THE INVENTION

The primary object of the present invention is to provide a fastening element insertion device with effective sound attenuation which does not seriously affect the driving energy.

In accordance with the present invention, the barrel is axially displaceable opposite to the driving direction under the influence of the propellant gases generated when an explosive charge is fired, and the exhaust passageways for the propellant gases include a passageway with a throttle device displaceable relative to the passageway so that a throttling cross-section can be varied during the driving operation.

As compared to the known state of the art, the throttling cross-section of the exhaust flow out of the device does not remain constant during the driving operation, rather it adjusts in an effective manner to the pressure conditions as developed. Accordingly, the velocity of the propellant gases flowing out through the exhaust passageway into the atmosphere can be kept essentially constant or can be increased towards the end of the driving operation. As a result, the heating of the tool can be limited and its recoil reduced. The axial displaceability of the barrel can be effected by its axial displacement relative to the housing of the device or by an axial displacement with a portion of the housing connected to a handle on the device which is movable relative to another housing part which is pressed against the receiving material when a fastening element is driven. In the second embodiment just mentioned the mass of the driving piston to be accelerated as compared to the mass of the barrel moving in the opposite direction along with the breach block and the connected housing part is essentially larger, whereby the velocity of the barrel opposite to the driving velocity of the piston is relatively small. To utilize this feature, it is expedient if one part of the throttling device consists of a passageway and another part is formed by a throttle member connected to the barrel. Therefore, the throttle valve is opened by controlling the displacement of the barrel. Such control is a function of the barrel travel and not a function of time. This feature permits the use of propellant charges of different strengths.

The passage in the throttling device can assume different forms. As an example, a slit-shaped passage could be used. In a slit-shaped passage, which is relatively narrow in relation to its length, a problem of fouling can develop. A small deposit of residues of the explosive charge can change the cross-section of the passage or completely close it off. Therefore, it is advantageous if the throttle passageway is in the form of a bore. A passageway in the form of a bore can be easily manufactured and effectively cleaned. Basically, polygonally shaped passageways approaching a circular shape are also possible.

For effective sound attenuation as well as limiting the loss of driving power, it is advantageous if the increase in the throttling cross-section is relatively small at the commencement of the driving operation and becomes increasingly larger toward the end of the driving operation. To attain this characteristic it is advisable that the throttling member is in the form of an axially displaceable nozzle needle located in the throttle passageway. Depending on the profile or shape of the nozzle needle, the change in the throttling cross-section during a linear displacement of the nozzle needle can be in accordance with a quadratic or a higher exponential function. The change in the throttling cross-section takes place by a displacement of the throttle member relative to the passageway. Such displacement is effected by the axial displacement of the barrel. In principle, it is not important whether the passageway or the throttling member is connected to the barrel. For constructional reasons, however, it has proved to be advantageous to interconnect the barrel and the throttling member. The throttling member can be adjustably connected to the barrel whereby, if required, an adjustment of the throttling member with respect to the barrel can be effected.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
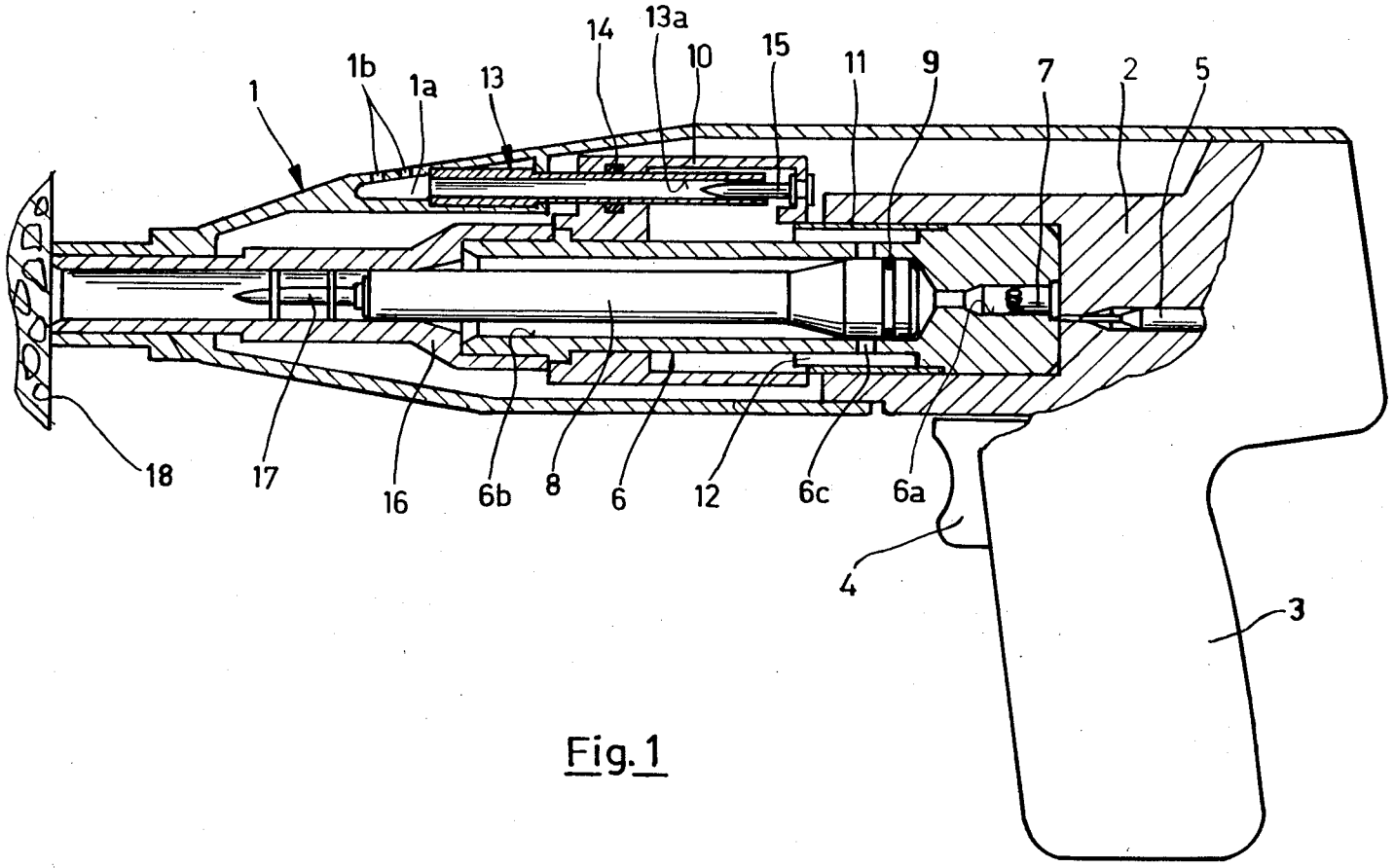
FIG. 1 is an elevational view, partly in section, of a fastening element driving device, embodying the present invention, illustrated in position ready to drive a fastening element.
Figure 2:
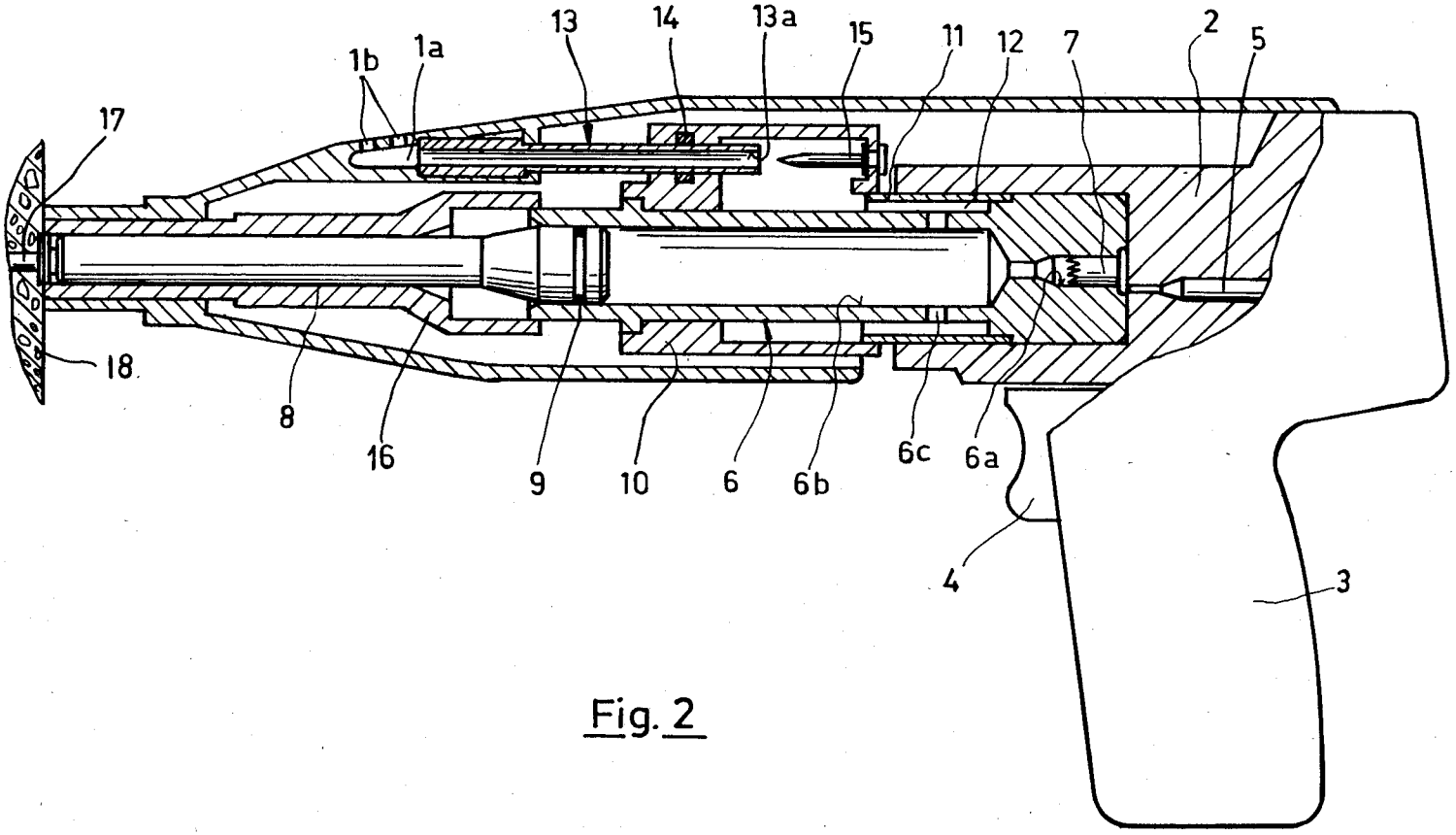
FIG. 2 is an elevational view similar to FIG. 1, however, illustrating the device after a fastening element has been driven into a receiving material.

A device for driving fastening elements into a receiving material is illustrated in FIGS. 1 and 2 and includes a housing 1 with a breech part 2 axially displaceable relative to the housing. The breech part 2 is connected with a handle 3 extending downwardly from the breech part as shown in the drawing. A trigger is located in the handle for firing the device. An ignition pin 5 is axially displaceably mounted in the breech part 2. An axially extending barrel 6 is positioned within the housing ahead of the breech part 2 and is supported in the breech part so that it can be displaced in the axial direction. The driving direction of the device is to the left as viewed in FIGS. 1 and 2 so that the barrel has a first or front end at the left and a rear or second end at the right. The second end of the barrel 6 forms a cartridge chamber 6*a* for an explosive charge or cartridge 7. The barrel forms a guide bore 6*b* extending in the firing direction and a driving piston 8 is axially displaceably guided in the bore. At its rear end, the driving piston 8 has a piston ring 9 which affords a sealing action and also holds the driving piston in position ready to be fired, as shown in FIG. 1. A silencer or sound attenuation chamber 10 is fixed to the barrel 6. In the rear portion of the bore 6*b* propellant gas exhaust openings 6*c* extend radially through the barrel. At the rear end of the sound attenuation chamber 10, closer to the cartridge chamber, a tube 11 is connected to and extends around the outer surface of the barrel 6. As a result, an annular channel 12 is formed between the outside of the barrel 6 and the inside of the tube 11 concentric with the barrel with the exhaust openings 6*c* opening to the annular channel. The separation between the tube 11 and the sound attenuation chamber 10 is for production reasons and is not required for operation. A tubular member 13 extends parallel to and is spaced outwardly from the barrel and is connected to the housing 1. The tubular member 13 is rigidly secured to the housing and has a bore 13*a* forming an exhaust passageway. Chamber 10 has a seal 14 encircling the outside surface of the tubular member 13. Seal 14 prevents any escape of the propellant gases through the annular gap between the tubular member 13 and the chamber 10 required for affording relative axial displaceability of the barrel with regard to the housing 1 or the tubular member 13. A nozzle needle 15 is connected to the rear end of the chamber 10 or it may be connected with the barrel 6. The needle extends axially into the rear end of the passageway 13*a* in the tubular member 13 in the position shown in FIG. 1. A fastening element guide 16 is supported on the front end of the barrel so that it is axially displaceable within the housing relative to the barrel. In the positions illustrated in FIGS. 1 and 2, the front end of the fastening element guide 16 is flush with the front end of the housing 1. In FIG. 2 the guide 16 is shown axially displaced relative to the barrel 6.

In FIG. 1 a fastening element 17 has been inserted into the guide 16 so that it bears against the front end of the piston 8. When the trigger 4 is pressed into the handle 3, the firing mechanism is actuated and the ignition pin is accelerated through the breech part 2 toward the rear end of the barrel 6 in a known manner, not shown, so that it strikes the explosive charge or cartridge 7 causing ignition. With the cartridge fired, propellant gases are developed which act on the rear end face of the driving piston 8 and on the shoulder formed at the rear end of the bore 6*b* in the barrel 6 which shoulder tapers inwardly toward one end of the cartridge chamber 6*a*. Due to the pressure of the propellant gas acting on the projected areas of the piston and the shoulder, forces are generated which accelerates the piston 8 and the fastening element 17 in the direction of the receiving material 18 and also displace the barrel 6 along with the breech part 2 and the handle 3 in the opposite direction, note the rear end of the device in FIG. 2 as compared to FIG. 1.

Due to the reverse movement of the barrel 6 together with the sound attenuation chamber 10 and the nozzle needle 15 a relative displacement takes place between the rear end of the tubular member 13 and the nozzle needle 15, compare FIGS. 1 and 2. The propellant gases displace the piston axially forwardly through the barrel and the driving piston 8 exposes the exhaust openings 6*c* in the barrel with a part of the propellant gases flowing to the sound attenuation chamber 10 through the annular channel 12. In combination, the tubular member 13 and the nozzle needle 15 form a throttle valve with the cross-section of the passageway within the tubular member at its rear end being increased with the reverse displacement of the barrel 6. The timewise progress of the cross-sectional enlargement of the passageway can be influenced by the appropriate shaping of the nozzle needle 15. As the throttle valve is opened, the propellant gases flow into the sound attenuation chamber through the tubular member 13 and pass into an expansion chamber 1*a* located in the housing 1 at the front end of the tubular member. From the expansion chamber 1*a* the gases flow through outlet openings 1*b* in the housing into the atmosphere. Within the sound attenuation chamber 10, as well as in the throttle valve formed by the needle 15 and the tubular member 13 and in the expansion chamber 1*a*, a significant portion of the energy of the propellant gases is absorbed and the flow of the gases out of the housing 1 through the openings 1*b* takes place at a relatively low sound level. The exhaust flow of the propellant gases occurs during a relatively short time period, because of the rapidly increasing cross-section of the throttle valve which takes place toward the end of the reverse movement of the barrel, whereby heating of the corresponding parts of the device is relatively slight. Moreover, the recoil of the device is reduced by the pressure reduction taking place toward the end of the driving process.

The position of the parts of the device at the end of the driving process as displayed in FIG. 2, illustrates that the passageway 13*a* through the tubular member 13 is completely opened by the rearward movement of the needle 15. Accordingly, the resistance to the exhaust flow of the propellant gases is reduced with the pressure reduction taking place toward the end of the driving process whereby the propellant gases can escape into the atmosphere practically unhindered.

While specific embodiments of the invention have been shown and described in detail to illustrate the application of the inventive principles, it will be understood that the invention may be embodied otherwise without departing from such principles.

I claim:

1. Explosive charge operated device for driving fastening elements into a receiving material comprises a housing, an axially elongated barrel axially displaceably mounted in said housing, said barrel having a first end and a second end with the driving-in direction of the fastening element being in the second end toward the first end direction, means for firing an explosive charge for supplying propellant gases in the second end of said barrel for driving a fastening element, means for conveying propellant gases from said barrel out of said housing, said barrel being axially displaceable under the action of the propellant gases when the explosive charge is fired in the direction opposite to the driving-in direction, said means for conveying propellant gases includes a throttling device comprising an axially extending passageway having a first end and a second end and a throttle member mounted in the second end of said passageway and being displaceable relative to said passageway for providing a variable throttling cross-section through said passageway when a cartridge is fired for driving a fastening element.

2. Explosive charge operated device, as set forth in claim 1, wherein one of said passageway and said throttle member is fixed to said barrel.

3. Explosive charge operated device, as set forth in claim 2, wherein said passageway comprises an axially extending tubular member having an axially extending bore therethrough defining said passageway.

4. Explosive charge operated device, as set forth in claim 1, wherein said passageway comprises an axially extending tubular member having an axially extending bore therethrough defining said passageway.

5. Explosive charge operated device, as set forth in claim 1, 2, 4 or 3, wherein said throttle member is an axially extending nozzle needle positionable within and axially displaceable relative to said passageway.

6. Explosive charge operated device, as set forth in claim 5, wherein said nozzle needle has a first end insertable into said passageway and a second end connected to said barrel, said first end of said throttle body being conically shaped for affording a variable cross-sectional throttling opening in said passageway as said throttling body is displaced with said barrel relative to said passageway.

7. Explosive charge operated device, as set forth in claim 6, wherein said passageway is fixed to said housing, said housing forming an expansion chamber in communication with one end of said passageway, and openings in said housing communicating with said expansion chamber for exhausting propellant gases out of said propellant chamber to the atmosphere.

8. Explosive charge operated device, as set forth in one of claims 1, 2, 4 or 3, wherein said throttle member is fixed to said barrel for axial displacement with said barrel relative to said passageway.

9. Explosive charge operated device, as set forth in claim 1, wherein said housing having a front end from which the fastening elements are driven and an opposite rear end, means within said housing for guiding said barrel, said barrel and said means being axially displaceable relative to said housing so that said means move rearwardly from the rear end of said housing when an explosive charge is fired.

* * * * *

UNITED STATES PATENT AND TRADEMARK OFFICE

CERTIFICATE OF CORRECTION

PATENT NO. : 4,595,134

DATED : June 17, 1986

INVENTOR(S) : Peter Jochum

It is certified that error appears in the above-identified patent and that said Letters Patent is hereby corrected as shown below:

In the heading of the Patent, it should read:

-- [73] Assignee: Hilti Aktiengesellschaft, Fürstentum Liechtenstein

Signed and Sealed this

Twenty-first Day of October, 1986

[SEAL]

*Attest:*

DONALD J. QUIGG

*Attesting Officer*

*Commissioner of Patents and Trademarks*